US006568918B2

(12) United States Patent
Sugioka et al.

(10) Patent No.: US 6,568,918 B2
(45) Date of Patent: May 27, 2003

(54) LUBRICATION COATING FOR THE SLIDING PORTION OF A SWASHPLATE COMPRESSOR

(75) Inventors: Takahiro Sugioka, Kariya (JP); Takayuki Kato, Kariya (JP); Tetsuji Yamaguchi, Kanagawa-ken (JP)

(73) Assignee: Kabushiki Kaisha Tokyo Jidoshokki, Kariya (JP)

( * ) Notice: Subject to any disclaimer, the term of this patent is extended or adjusted under 35 U.S.C. 154(b) by 0 days.

(21) Appl. No.: 09/952,218

(22) Filed: Sep. 13, 2001

(65) Prior Publication Data

US 2002/0067996 A1 Jun. 6, 2002

(30) Foreign Application Priority Data

Sep. 13, 2000 (JP) ..... 2000-278259

(51) Int. Cl.[7] ..... F04B 1/12; F01B 31/10

(52) U.S. Cl. ..... 417/269; 417/222.2; 92/71; 92/155; 184/6.17

(58) Field of Search ..... 417/269, 222.2; 92/71, 155; 184/6.17

(56) References Cited

U.S. PATENT DOCUMENTS 5,056,417 A * 10/1991 Kato et al. ..... 92/71
5,934,170 A * 8/1999 Morita ..... 417/269
6,289,785 B1 * 9/2001 Ikeda et al. ..... 417/269
6,308,615 B1 * 10/2001 Takenaka et al. ..... 92/155
6,337,141 B1 * 1/2002 Yamada et al. ..... 428/553
6,378,415 B1 * 4/2002 Sugiura et al. ..... 92/155
6,487,958 B2 * 12/2002 Sugiura et al. ..... 92/155
2002/0046647 A1 * 4/2002 Sugiura et al. ..... 92/71
2002/0174764 A1 * 11/2002 Kato et al. ..... 92/70

FOREIGN PATENT DOCUMENTS

| | | |
|---|---|---|
| EP | 0911517 A2 | 4/1999 |
| JP | 60-22080 | 2/1985 |
| JP | 8-199327 | 8/1996 |
| JP | 10-205442 | 8/1998 |

* cited by examiner

*Primary Examiner*—Cheryl J. Tyler
(74) *Attorney, Agent, or Firm*—Morgan & Finnegan, LLP

(57) ABSTRACT

A swash plate slides on a plurality of shoes. A lubrication coating is applied to the swash plate. The lubrication coating includes a non-graphite solid lubricant, a transfer adjusting agent, and a resin binder. The transfer adjusting agent adjusts the amount of the solid lubricant that is transferred from the swash plate to the shoes. The materials and quantities of the coating are chosen to extend the life of the parts.

12 Claims, 4 Drawing Sheets

LUBRICATION COATING FOR THE SLIDING PORTION OF A SWASHPLATE COMPRESSOR

BACKGROUND OF THE INVENTION

The present invention relates to movable parts of compressors, and, more particularly, to parts on which lubrication coatings are applied for reducing friction.

As described in Japanese Unexamined Patent Publication Nos. 60-22080, 8-199327, and 10-205442, a piston of a swash plate type compressor reciprocates by rotation of a swash plate, which rotates integrally with a drive shaft of the compressor. More specifically, shoes connect the piston to opposite surfaces of the swash plate, thus transmitting motion of the swash plate to the piston. The shoes are formed of iron-based material and they slide on the swash plate when the swash plate rotates. This wears sliding the portion of each shoe that contacts the swash plate and the sliding portion of the swash plate that contacts the shoes. The sliding contact may also result in a seizure between the shoes and the swash plate. It is thus necessary to reduce friction between the shoes and the swash plate.

The sliding components of the compressor wear quickly or are likely to cause a seizure particularly under severe conditions, for example, when the components are not sufficiently lubricated immediately after the compressor is started or when an increased load is applied to the movable components.

Accordingly, in each aforementioned publication, each sliding portion of the swash plate that contacts the shoes is provided with a lubrication coating. The main component of the lubrication coating is molybdenum disulfide, which is a solid lubricant. The coating also contains graphite. The lubrication coating enables the swash plate to move smoothly with respect to the shoes.

However, seizure may still occur under severe conditions and various other conditions, for example, when the compressor is operated at a relatively high speed or with a relatively small displacement, which causes insufficient lubrication. Thus, to solve this problem, the amount of solid lubricant transferred to the component contacted by the coating is increased to prolong the life of the lubrication coating. The present invention focuses on this point. Further, the present invention has been accomplished based on a number of experiments.

SUMMARY OF THE INVENTION

Accordingly, it is an objective of the present invention to provide a lubrication coating that is applied to a sliding component of compressor to reduce friction.

To achieve the foregoing and other objectives and in accordance with the purpose of the present invention, the invention provides a part of a compressor. The part is one of a pair of parts that slide with respect to one another. A lubrication coating is applied to the part. The lubrication coating includes a non-graphite solid lubricant, a transfer adjusting agent and a resin binder. The transfer adjusting agent adjusts the amount of the solid lubricant transferred from the part to the other part of the pair.

Graphite with a stratified or flaky crystalline structure has an improved lubrication performance, as compared to the substance in the form of particles (or fine powder). A conventional graphite-contained lubrication coating thus employs vein graphite that has a relatively high lubrication performance. In contrast, amorphous graphite has a relatively low lubrication performance and is contained in a lubrication coating that contains non-graphite, solid lubricant. However, if the compressor is operated under the aforementioned severe conditions, this lubrication coating, which contains the non-graphite solid lubricant and the amorphous graphite, indicates a higher lubrication performance than the conventional lubrication coating that contains the vein graphite. It is thus assumed the amorphous graphite promotes transfer of the non-graphite solid lubricant to the component contacted by the coating, although the lubrication performance of the substance is relatively low. In other words, the amorphous graphite functions as a transfer adjusting agent.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 1(*b*) is an enlarged cross-sectional view showing a main portion of the compressor;

DETAILED DESCRIPTION OF THE PREFERRED EMBODIMENTS

An embodiment of the present invention will now be described with reference to FIGS. 1 to 3.

Figure 1:
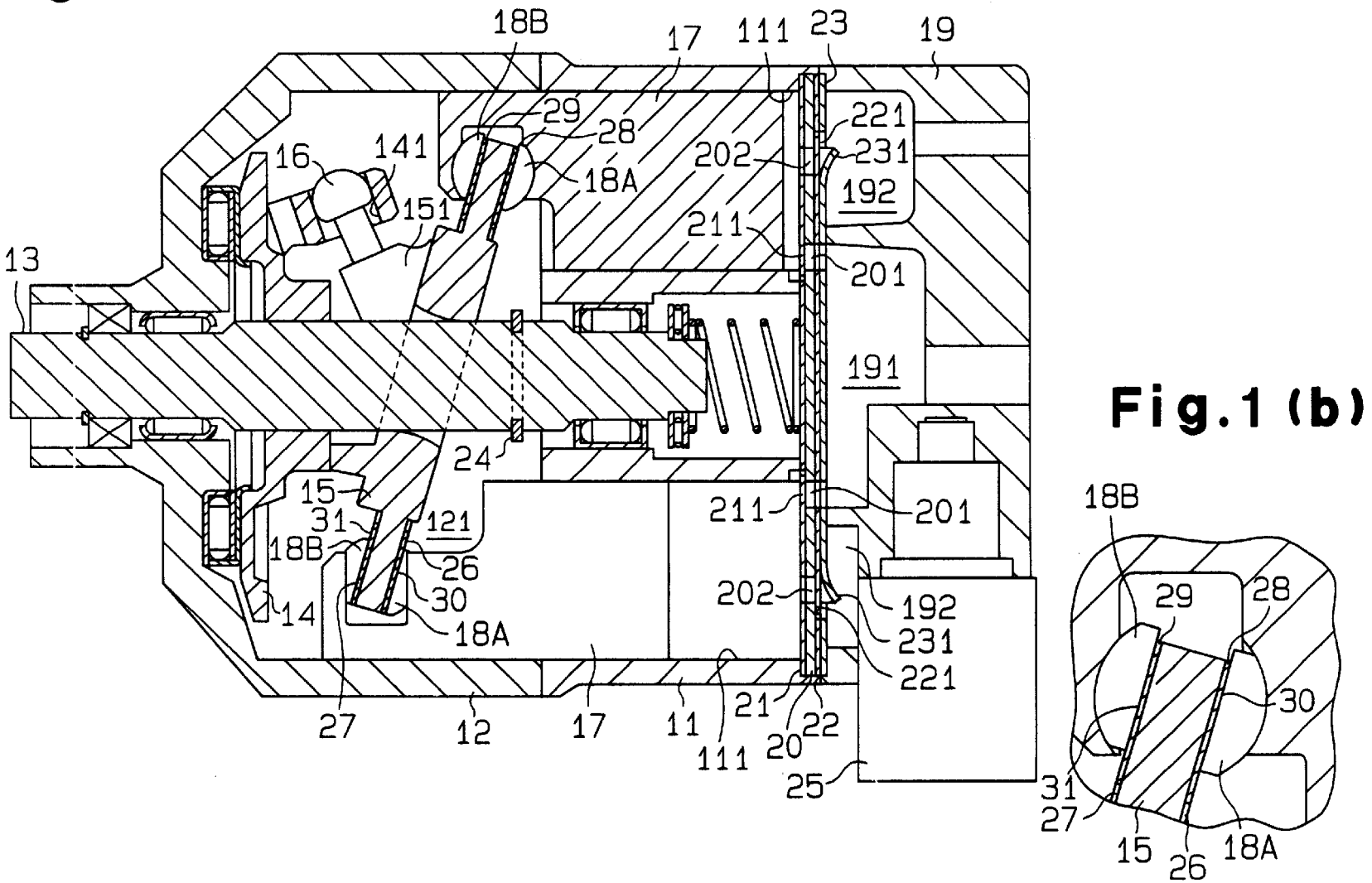
FIG. 1(*a*) is a cross-sectional view showing a compressor of a first embodiment according to the present invention.

As shown in FIG. 1(*a*), a variable displacement compressor includes a crank chamber 121 that is formed by a front housing member 12 and a cylinder block 11. A drive shaft 13 of the compressor is supported by the front housing member 12 and the cylinder block 11. The drive shaft 13 is driven by an external drive source (for example, the engine of a vehicle). A lug plate 14 is secured to the drive shaft 13. A swash plate 15 is supported by the drive shaft 13 and axially moves along the drive shaft 13 while inclining with respect to the drive shaft 13. The swash plate 15 is formed of iron type material, and a support 151 is formed integrally with the swash plate 15. A pair of guide pins 16 (only one is shown) are secured to the support 151. Each guide pin 16 is received in a guide hole 141 that extends through the lug plate 14, and slides in the guide hole 141. This enables the swash plate 15 to axially slide along the drive shaft 13, incline with respect to the drive shaft 13, and rotate integrally with the drive shaft 13. In other words, movement of the swash plate 13 is guided by the guide holes 141, the guide pins 16, and the drive shaft 13.

The angle at which the swash plate 15 inclines with respect to the drive shaft 13 is changed by controlling the pressure in the crank chamber 121. If the pressure in the crank chamber 121 increases, the inclination angle of the swash plate 15 decreases. If the pressure in the crank chamber 121 decreases, the inclination angle of the swash plate 15 increases. A suction chamber 191 is formed in a rear housing member 19 of the compressor. Refrigerant flows from the crank chamber 121 to the suction chamber 191 through a pressure releasing passage (not shown). A discharge chamber 192 is also formed in the rear housing member 19. Refrigerant flows from the discharge chamber 192 to the crank chamber 121 through a pressure supply passage (not shown). A displacement control valve 25 is formed in the pressure supply passage and adjusts the flow rate of the refrigerant that flows from the discharge chamber 192 to the crank chamber 121. If this rate increases, the pressure in the crank chamber 121 increases, and if the rate decreases, the pressure in the crank chamber 121 decreases. In other words, the displacement control valve 25 controls the inclination angle of the swash plate 15.

When the swash plate 15 abuts against the lug plate 14, the swash plate 15 inclines at a maximum inclination angle. When the swash plate 15 abuts against a snap ring 24 that is fitted around the drive shaft 13, the swash plate 15 inclines at a minimum inclination angle.

A plurality of cylinder bores 111 (only two are shown in FIG. 1(*a*)) are formed around the drive shaft 13 in the cylinder block 11. Each cylinder bore 111 accommodates a piston 17. When the swash plate 15 rotates integrally with the drive shaft 13, the rotation of the swash plate 15 is converted to reciprocating movement of the pistons 17 through corresponding semi-spherical shoes 18A, 18B. In this state, the pistons 17 move in the corresponding cylinder bores 111. Each shoe 18A, 18B is formed of bearing steel. The shoe 18A slides on a contact surface 30 of the swash plate 15, and the shoe 18B slides on a contact surface 31 of the swash plate 15.

A suction port 201 and a discharge port 202 are formed in a central valve plate 20 at positions corresponding to each piston 17. A front valve plate 21 includes a suction valve 211 at a position corresponding to each suction port 201. A rear valve plate 22 includes a discharge valve 221 at a position corresponding to each discharge port 202. As one of the pistons 17 moves from its top dead center to its bottom dead center (from the right to the left, as viewed in FIG. 1(*a*)), refrigerant flows from the suction chamber 191 to the associated cylinder bore 111 through the associated suction port 201, which is opened by the suction valve 211. If the piston 17 moves from the bottom dead center to the top dead center (from the left to the right, as viewed in the drawing), the refrigerant flows from the cylinder bore 111 to the discharge chamber 192 through the discharge port 202, which is opened by the discharge valve 221. The opening size of each discharge valve 221 is limited by abutment between the discharge valve 221 and a retainer 231 that is formed on a retainer plate 23.

As shown in FIGS. 1(*a*) and 1(*b*), a rear lubrication coating 28 is formed on a rear surface 26 of the swash plate 15, and a front lubrication coating 29 is formed on a front surface 27 of the swash plate 15. Although not illustrated, a sprayed aluminum coating is applied to each surface 26, 27 of the swash plate 15, and each lubrication coating 28, 29 is applied to the corresponding aluminum sprayed coating. The lubrication coating 28, 29 contains molybdenum disulfide, amorphous graphite, and polyamideimide. Polyamideimide is a binder formed of thermally hardened resin. More specifically, molybdenum disulfide and amorphous graphite are first dispersed in polyamideimide. The mixture is then applied to each surface 26, 27 of the swash plate 15 and is calcinated at 230 degrees Celsius, thus forming the lubrication coatings 28, 29. The thickness of each lubrication coating 28, 29 is 6 $\mu$m to 24 $\mu$m.

Figure 8:
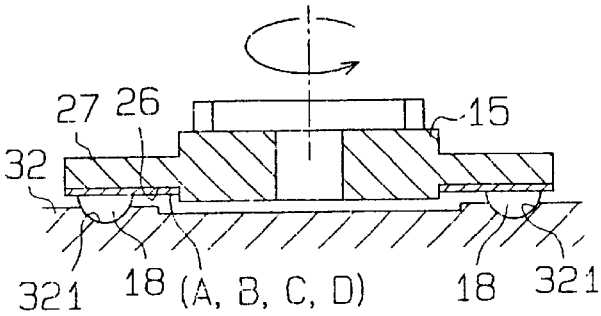
FIG. 8 is a cross-sectional view showing a test apparatus for the seizure tests.

To determine the composition of the lubrication coating 28, 29, seizure tests were performed with four types of lubrication coatings A, B, C, D. The lubrication coatings A, B, C, D contained molybdenum disulfide as a solid lubricant, polyamideimide as a binder, and different types of graphite. FIG. 2 shows the test results. The tests were conducted with the apparatus shown in FIG. 8. In the apparatus, shoes 18 were fitted in a plurality of recesses 321 formed in a table 32. Each lubrication coating A, B, C, D was formed on the rear surface 26 of the swash plate 15. The swash plate 15 was rotated such that the lubrication coating A, B, C, D slid on the shoes 18. No lubricant oil was supplied. The circumferential speed of the swash plate 15 at a portion of the swash plate 15 that contacted the shoes 18 was 10.5 m/s. The swash plate 15 was urged toward the table 32 with a force of 200 kgf.

The thickness of each lubrication coating A, B, C, D was 20 $\mu$m. Lubrication coating A contained vein graphite, the average particle size of which was 5 $\mu$m. Lubrication coating B contained artificial graphite, the average particle size of which was 6 $\mu$m. Lubrication coating C contained amorphous graphite, the average particle size of which was 2.5 $\mu$m. Lubrication coating D contained artificial graphite, the average particle size of which was 0.7 $\mu$m. Each lubrication coating A, B, C, D contained 25 vol. % of molybdenum disulfide, 25 vol. % of graphite, and 50 vol. % of polyamideimide.

It was defined that a seizure occurred when the thickness of the portion of the lubrication coating A, B, C, D that contacted the shoes 18 became zero. Lubrication coating A caused a seizure within one minute after the test was started. Lubrication coating B caused a seizure when about one minute elapsed after the test was started. Lubrication coating C, which contained amorphous graphite, caused a seizure when about ten minutes had elapsed after the test was started. Lubrication coating D caused a seizure when about four minutes had elapsed after the test was started.

Figure 7:
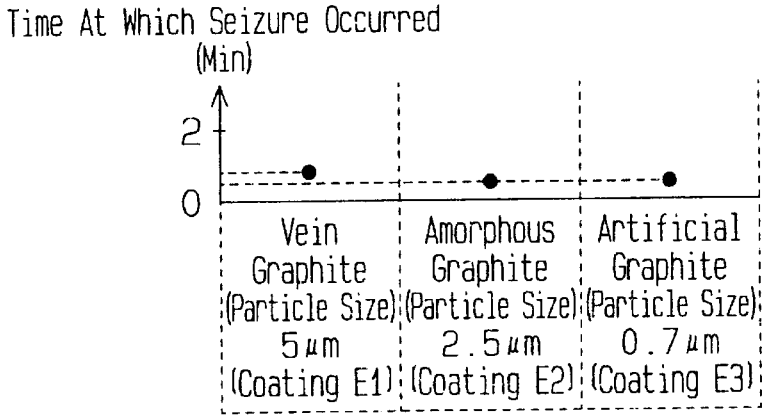
FIG. 7 is a graph of the times at which seizure occurs for three types of lubrication coatings, each of which contains a different form of graphite and uses only graphite as solid lubricant.

The test results indicated that lubrication coating C, which contained amorphous graphite, had an improved anti-seizure performance. Thus, seizure tests were re-conducted with three types of lubrication coatings E1, E2, E3, which contained no solid lubricant other than graphite. More specifically, lubrication coatings E1, E2, E3 contained different types of graphite and a single binder, or polyamideimide. FIG. 7 shows the test results. Lubrication coating E1 contained vein graphite, the average particle size of which was 5 $\mu$m. Lubrication coating E2 contained amorphous graphite, the average particle size of which was 2.5 $\mu$m. Lubrication coating E3 contained artificial graphite, the average particle size of which was 0.7 $\mu$m. The tests were conducted with the same apparatus and under the same conditions as the tests represented by FIG. 2. The thickness of each lubrication coating E1, E2, E3 was 20 $\mu$m. Lubrication coatings E1 to E3 each contained 50 vol. % of polyamideimide.

As shown in FIG. 7, all lubrication coatings E1 to E3 caused a seizure within one minute after the test was started. It is thus indicated that the anti-seizure performance of a lubrication coating that contains graphite as a single solid lubricant is relatively low.

From the tests conducted with the four lubrication coatings A, B, C, D, it was assumed that the life of the lubrication coating was prolonged due to an increase in the amount of the solid lubricant that was transferred to the components contacted by the coating. Thus, the amount of the solid lubricant including molybdenum and carbon that was transferred from the swash plate 15 to the shoes 18 was analyzed for the lubrication coatings A, B, C, D. FIG. 3 shows the analysis results. The analysis was conducted with the same apparatus under the same conditions as the tests represented by FIG. 2. The amount of the solid lubricant that was transferred was analyzed using an energy-dispersed type X-ray analysis apparatus (product of HORIBA SEISAKUSHO, EMAX-5770W). More specifically, the analysis was performed on the surface of each shoe 18 (that contacted the swash plate 15) when about 30 seconds had elapsed after the rotation of the swash plate 15 was started. The thickness of the analyzed surface was approximately 10 $\mu$m, which corresponds to the depth that X rays penetrate.

For each lubrication coating A, B, C, D, the amount of carbon transferred (as indicated by wt. %) was not more than 5 wt. %. Among the four lubrication coatings A to D, lubrication coating C, which contained amorphous graphite, transferred the largest amount of carbon to the shoes 18. Further, the amount of molybdenum transferred was two wt. % in lubrication coatings A and B, 44 wt. % in lubrication coating C, and 17 wt. % in lubrication coating D. The remainder of the weight percentage in each lubrication coating A, B, C, D (51 wt. % in the lubrication coating C, which was obtained by subtracting 5 wt. % of carbon and 44 wt. % of molybdenum) reflected the weight of iron, the material of the shoes 18. In the analysis of the amount of transferred molybdenum, both molybdenum and sulfur were analyzed such that the resulting amount corresponded to molybdenum disulfide.

Figure 4:
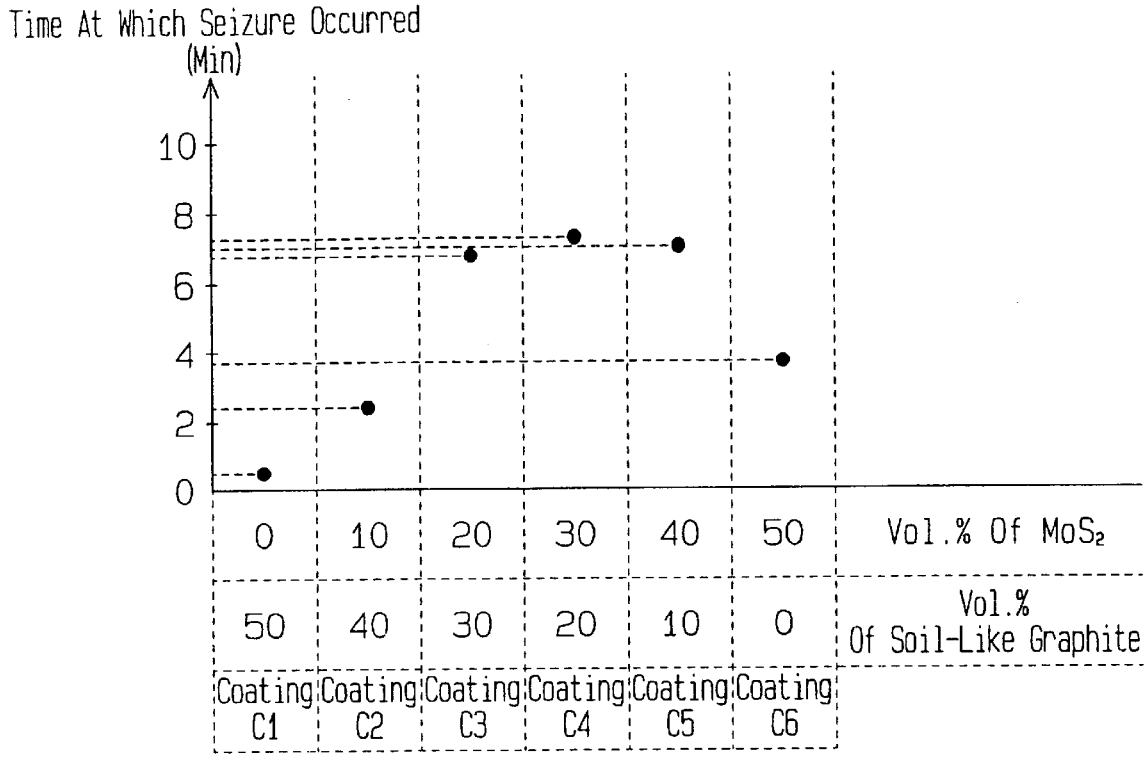
FIG. 4 is a graph of the times at which seizure occurs for various lubrication coatings, each of which has a different volume percentage ratio of amorphous graphite to molybdenum disulfide.

The analysis results indicated that amorphous graphite promoted the transfer of the solid lubricant. Thus, seizure tests were conducted with six types of lubrication coatings C1, C2, C3, C4, C5, C6. All lubrication coatings C1 to C6 contained amorphous graphite, molybdenum disulfide, and polyamideimide. However, the volume percentage ratio of graphite to molybdenum disulfide was different from one lubrication coating to another. FIG. 4 shows the test results. The tests were performed with the same apparatus under the same conditions as the tests represented by FIG. 2. The thickness of each lubrication coating C1 to C6 was 20 $\mu$m. Further, the average particle size of the amorphous graphite was 2.5 $\mu$m in the lubrication coatings C1 to C6. In addition, all lubrication coatings C1 to C6 contained 50 vol. % of polyamideimide.

The ratio of molybdenum disulfide to amorphous graphite was 0 to 50 vol. % in the lubrication coating C1; 10 to 40 vol. % (1:4) in the lubrication coating C2; 20 to 30 vol. % (2:3) in the lubrication coating C3; 30 to 20 vol. % (3:2) in the lubrication coating C4; 40 to 10 vol. % (4:1) in the lubrication coating C5, and 50 to 0 vol. % in the lubrication coating C6.

Figure 5:
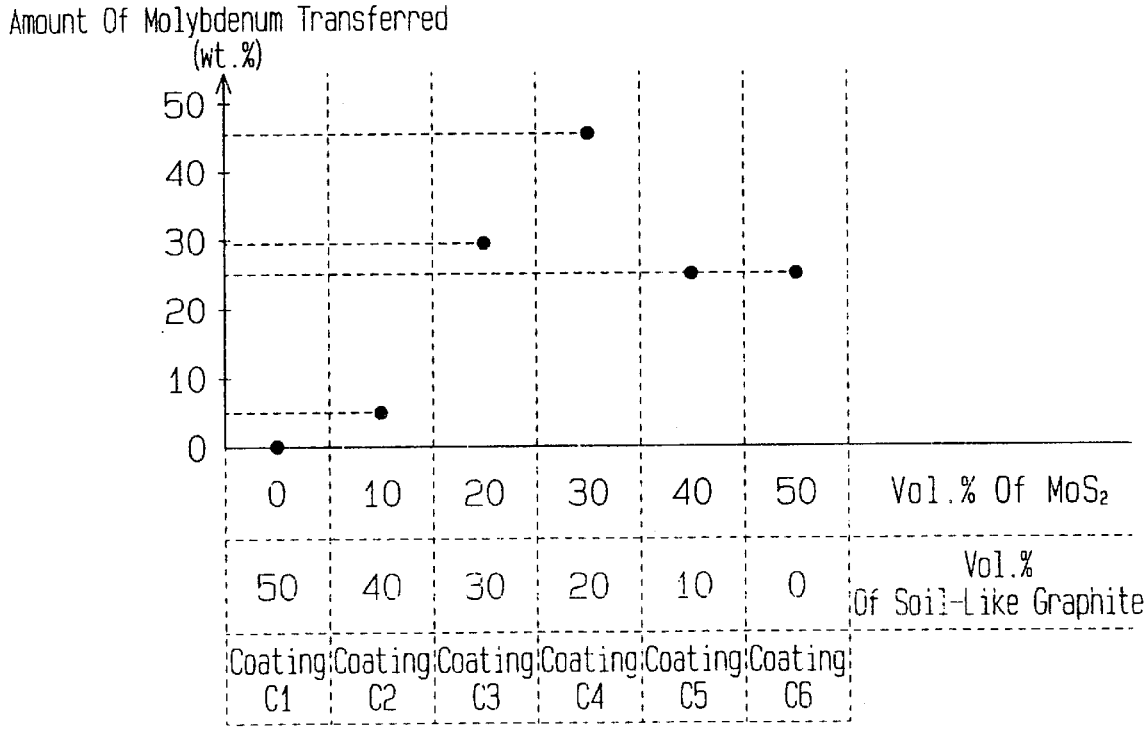
FIG. 5 is a graph showing amounts of transferred molybdenum for the lubrication coatings of FIG. 4.

The tests results indicated that the lubrication coatings C3, C4, C5 each had an improved anti-seizure performance. Thus, tests were further conducted to determine whether or not the improvement of the anti-seizure performance was caused by an increase in the amount of the solid lubricant transferred from the coatings to the shoes 18. That is, the amount of molybdenum transferred from each lubrication coating C1 to C6 to the shoes 18 was analyzed. FIG. 5 shows the analysis results. The analysis was performed with the same apparatus under the same conditions as the analysis represented by to FIG. 3.

The illustrated embodiment has the following advantages.

Figure 2:
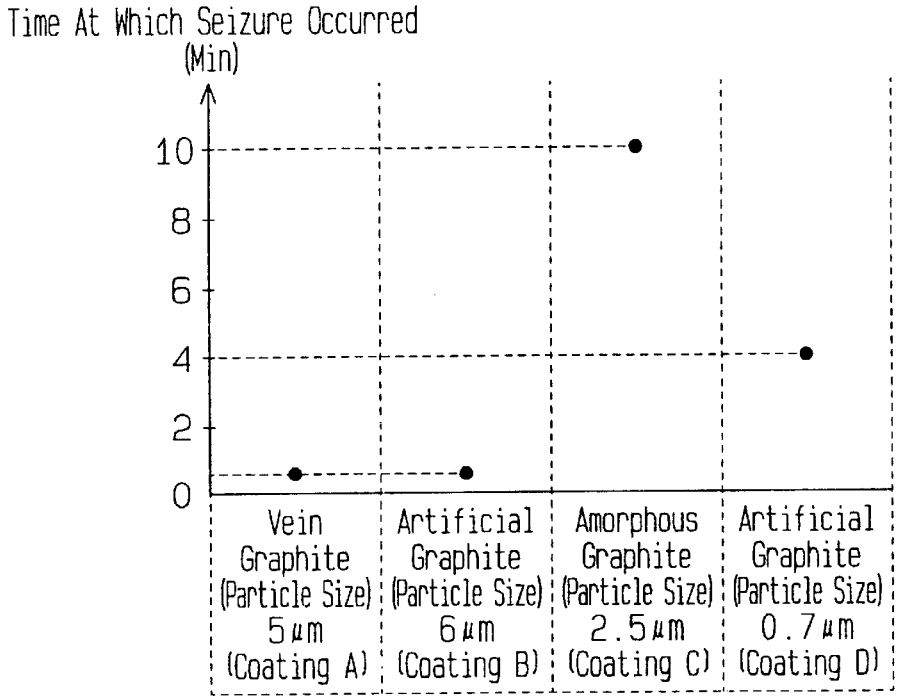
FIG. 2 is a graph of the times at which seizure occurs for four types of lubrication coatings, each of which contains a different form of graphite.

As is clear from the results shown in FIG. 2, if the lubrication coating contains amorphous graphite like the lubrication coating C, the anti-seizure performance of the lubrication coating is increased as compared to that of a lubrication coating that contains another type of graphite, like the lubrication coatings A, B, D.

As described, it was defined in the test that a seizure occurred when the thickness of each lubrication coating A, B, C, D became zero. In other words, by the time the seizure occurred, molybdenum disulfide and carbon in the lubrication coating A, B, C, D had been transferred from the rear surface 26 of the swash plate 15 to a corresponding surface of each shoe 18 or had been consumed. Each analysis of the transfer amount of the solid lubricant was performed when the thickness of the lubrication coating A, B, C, D became zero. As indicated by FIG. 3, the transfer amount of molybdenum from the lubrication coating C, which contained amorphous graphite, was greater than that of the other lubrication coatings A, B, D that contained other types of graphite, by a relatively large margin. Further, the transfer amount of carbon from the lubrication coating C was also greater than that of the other lubrication coatings A, B, D.

Accordingly, it is clear that the life of the lubrication coating is prolonged due to the increase in the amount of molybdenum disulfide transferred from the coating to a component contacted by the coating (in the illustrated embodiment, the shoes 18A, 18B). As shown in FIG. 3, the lubrication coating C, which had the best anti-seizure performance among the coatings A to D, transferred the largest amount of molybdenum disulfide to the shoes 18 among the coatings A to D. In other words, if the lubrication coating contains amorphous graphite like the lubrication coating C, the life of the lubrication coating is prolonged, as compared to that of a lubrication coating that contains another type of graphite like the lubrication coatings A, B, D.

From the analysis results of FIG. 5, it is clear that the amount of molybdenum disulfide transferred depends on the content of amorphous graphite in each lubrication coating C1 to C6. More specifically, the lubrication coatings C3, C4, C5, each of which had an improved anti-seizure performance compared to the other lubrication coatings C1, C2, C6, transferred an increased amount of molybdenum disulfide to the shoes 18 as compared to the lubrication coatings C1, C2, C6. Particularly, the lubrication coating C4, which had the best anti-seizure performance among the lubrication coatings C1 to C6, transferred the largest amount of molybdenum. Accordingly, FIG. 5 indicates that the amount of transferred molybdenum disulfide can be adjusted by varying the volume percentage ratio of amorphous graphite to molybdenum disulfide.

Figure 3:
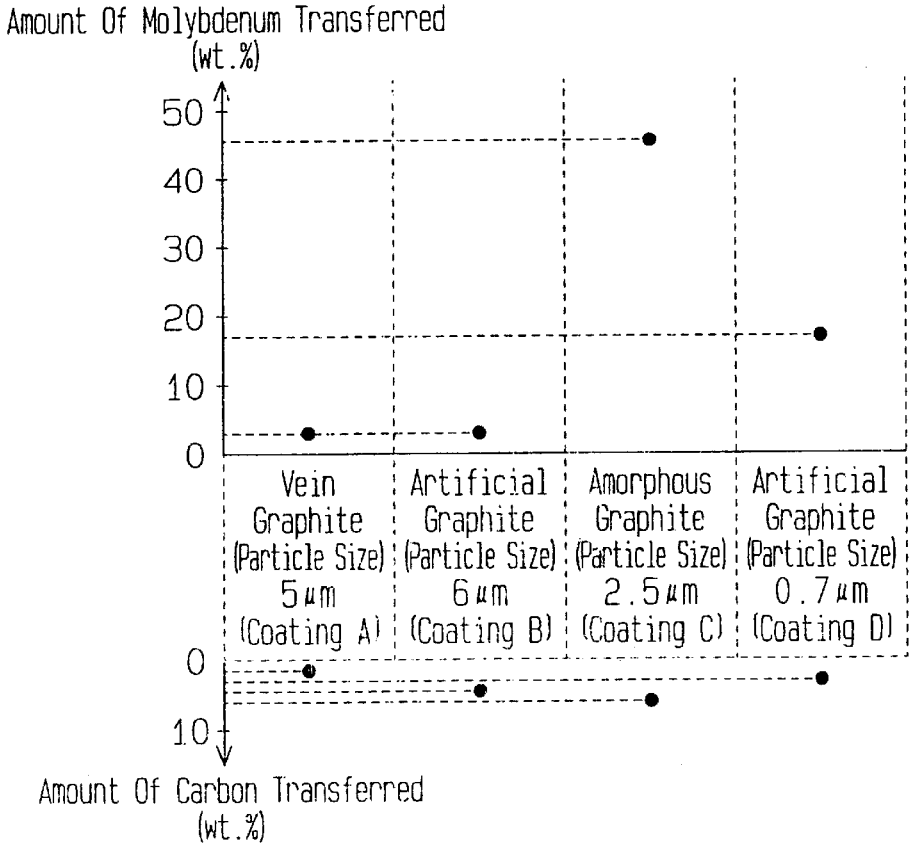
FIG. 3 is a graph showing amounts of transferred molybdenum for the lubrication coatings of FIG. 2.

Thus, FIGS. 3 and 5 indicate that amorphous graphite is preferred as a transfer adjusting agent for adjusting the amount of transferred solid lubricant other than graphite.

The lubrication coatings A, B, D were conventional lubrication coatings that contained vein graphite or artificial graphite, which have good lubrication performance. In contrast, lubrication coating C contained amorphous graphite, which has a poor lubrication performance. Lubrication coating C contains a solid lubricant other than graphite (in this embodiment, molybdenum disulfide), in addition to amorphous graphite. As described, amorphous graphite has poor lubrication performance but is preferred as the transfer adjusting agent. Accordingly, the lubrication characteristics of the lubrication coating C were improved, as compared to those of the conventional graphite-contained lubrication coatings. As a result, the lubrication coating C, which included amorphous graphite, is preferred as the lubrication coating applied on the swash plate 15.

As is clear from FIG. 4, the time that elapses before a seizure occurs for each lubrication coating depends on the content of amorphous graphite in the lubrication coating. More specifically, seizure is maximally delayed if the volume percentage ratio of amorphous graphite to molybdenum disulfide in the coating is substantially even. As shown in FIG. 4, if the volume percentage ratio of amorphous graphite to molybdenum disulfide was from 1:4 to 3:2, a seizure did not occur until after at least six minutes of the test. However, if the volume percentage ratio of amorphous graphite to molybdenum disulfide was smaller or larger than this range, a seizure occurred within less than four minutes after the test was started. Accordingly, it is preferred that the volume percentage ratio of amorphous graphite to molybdenum disulfide is from 1:4 to 3:2 for improving the anti-seizure performance of the lubrication coating.

As described, the rear surface 26 and the front surface 27 of the swash plate 15, which contact the corresponding surface of each shoe 18A, 18B, are vulnerable to friction. It is thus necessary to prepare the surfaces 26, 27 of the swash plate 15 to smoothly slide with respect to the shoes 18A, 18B. Accordingly, it is preferred that a lubrication coating that contains amorphous graphite is applied to the rear surface 26 and the front surface 27 of the swash plate 15.

As shown in FIG. 4, to obtain optimal anti-seizure performance, it is preferred that the volume percentage ratio of amorphous graphite to molybdenum disulfide is 2:3. However, in the test of FIG. 4, each lubrication coating contained a fixed amount, or 50 vol. %, of polyamideimide as the binder. Thus, even if the volume percentage ratio of amorphous graphite to molybdenum disulfide is 2:3, the anti-seizure performance of the lubrication coating may be affected if the quantity of the binder is changed.

Figure 6:
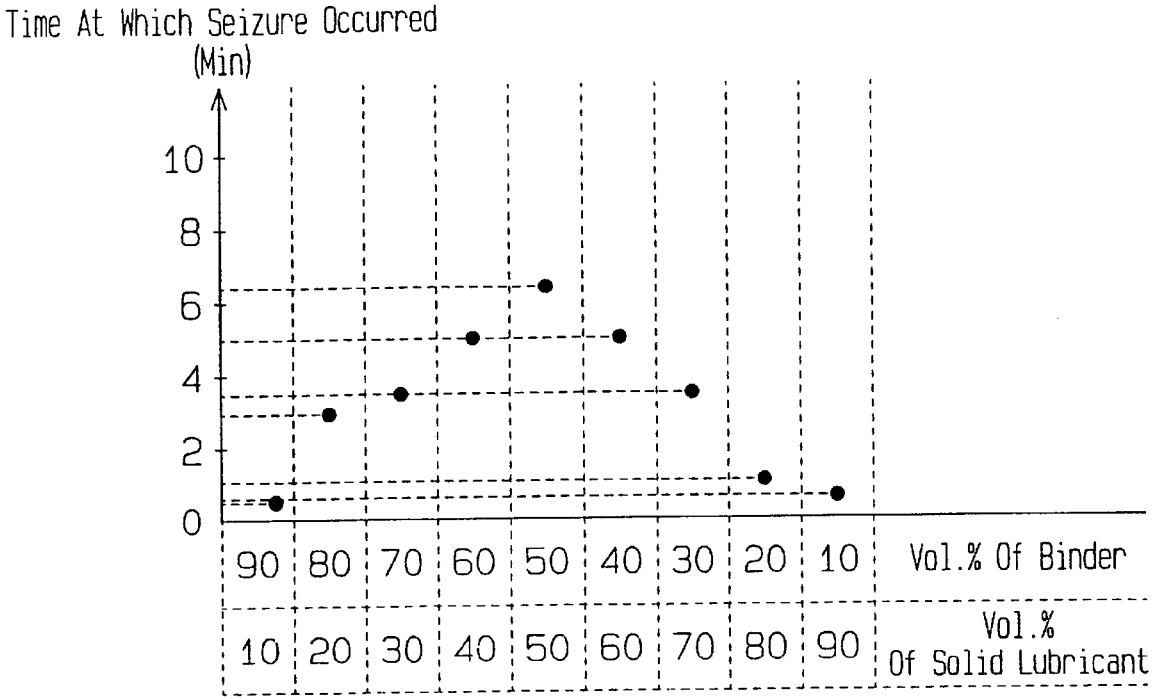
FIG. 6 is a graph of the times at which seizure occurs for various lubrication coatings, each of which contains a different volume percentage ratio of binder to lubricant.

Accordingly, seizure tests were conducted with lubrication coatings which the quantity of polyamideimide, the binder, was changed while maintaining the volume percentage ratio of amorphous graphite to molybdenum disulfide at 2:3. FIG. 6 shows the test results. As shown in FIG. 6, seizure was delayed in the lubrication coatings in which the volume percentage ratio of the binder to the solid lubricants was 7:3 to 3:7. More specifically, when the volume percentage ratio of the binder to the solid lubricants was 1:1, the seizure was maximally delayed to 7.3 minutes of elapsed time. In other words, it is the most desirable that the quantity of the binder in the lubrication coating is 50 vol. % to maximally delay a seizure.

It should be apparent to those skilled in the art that the present invention may be embodied in many other specific forms without departing from the spirit or scope of the invention. Particularly, it should be understood that the invention may be embodied in the following forms.

(1) The solid lubricant may be a substance other than molybdenum disulfide, for example, tungsten disulfide or polytetrafluoroethylene.

(2) The solid lubricant may be a mixture of molybdenum disulfide and polytetrafluoroethylene.

(3) The resin binder may be a substance other than polyamideimide, for example, polyamide types, epoxy types, or phenol types, which are highly heat-resistant.

(4) The lubrication coating may be applied to the contact surface of each piston 17.

Therefore, the present examples and embodiments are to be considered as illustrative and not restrictive and the invention is not to be limited to the details given herein, but may be modified within the scope and equivalence of the appended claims.

What is claimed is:

1. A part of a compressor, wherein the part is one of a pair of parts that slide with respect to one another, and wherein a lubrication coating is applied to the part, and the lubrication coating includes:

a non-graphite solid lubricant;

a transfer adjusting agent, which adjusts the amount of the solid lubricant transferred from the part to the other part of the pair; and a resin binder.

2. The part as set forth in claim 1, wherein the transfer adjusting agent is amorphous graphite.

3. The part as set forth in claim 2, wherein the solid lubricant is molybdenum disulfide.

4. The part as set forth in claim 3, wherein the volume percentage ratio of amorphous graphite to molybdenum disulfide is 1:4 to 3:2.

5. The part as set forth in claim 1, wherein the volume percentage ratio of the transfer adjusting agent to the solid lubricant is 1:4 to 3:2.

6. The part as set forth in claim 1, wherein the compressor is a swash plate type compressor and includes:

a rotary shaft;

a swash plate, which rotates integrally with the rotary shaft;

at least one piston; and a shoe, which is located between the swash plate and the piston to slide with respect to both the swash plate and the piston, such that motion of the swash plate is transmitted to the piston through the shoe to move the piston;

wherein the lubrication coating is applied to the swash plate such that the coating is between the swash plate and shoe.

7. The part as set forth in claim 1, wherein the content of the binder in the lubrication coating is 50 vol. %.

8. A swash plate type compressor comprising:

a rotary shaft;

a swash plate, which rotates integrally with the rotary shaft;

at least one piston;

a shoe, which is located between the swash plate and the piston to slide with respect to both the swash plate and the piston, such that motion of the swash plate is transmitted to the piston through the shoe to move the piston; and a lubrication coating applied to the swash plate such that the coating is between the swash plate and the shoe, wherein the lubrication coating includes a non-graphite solid lubricant, a transfer adjusting agent, which adjusts the amount of the solid lubricant transferred from the swash plate to the shoe, and a resin binder.

9. The compressor as set forth in claim 8, wherein the transfer adjusting agent is amorphous graphite.

10. The compressor as set forth in claim 9, wherein the solid lubricant is molybdenum disulfide.

11. The compressor as set forth in claim 10, wherein the volume percentage ratio of amorphous graphite to molybdenum disulfide is 1:4 to 3:2.

12. The compressor as set forth in claim 8, wherein the volume percentage ratio of the transfer adjusting agent to the solid lubricant is 1:4 to 3:2.

* * * * *